US007938161B2

(12) United States Patent
Lin

(10) Patent No.: US 7,938,161 B2
(45) **Date of Patent: *May 10, 2011**

(54) KIT FOR A ROMAN SHADE

(75) Inventor: Tzong Fu Lin, Taipei (TW)

(73) Assignee: Whole Space Industries Ltd., Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/473,901

(22) Filed: May 28, 2009

(65) Prior Publication Data

US 2010/0126679 A1 May 27, 2010

Related U.S. Application Data

(63) Continuation of application No. 12/390,952, filed on Feb. 23, 2009.

(60) Provisional application No. 61/118,227, filed on Nov. 26, 2008.

(51) Int. Cl.
*A47H 3/00* (2006.01)

(52) U.S. Cl. ..... 160/84.01; 24/115 F

(58) Field of Classification Search ..... 160/84.01, 160/84.04, 84.06, 178.1 R, 243, 173 R, 178.2; 24/115 F, 602, 667; 403/289, 290, 325, 327
See application file for complete search history.

(56) References Cited

U.S. PATENT DOCUMENTS

| | | | |
|---|---|---|---|
| 1,321,800 | A | 11/1919 | Andress et al. |
| 3,125,790 | A | 3/1964 | Gaylord |
| 4,909,298 | A | 3/1990 | Langhart |
| 5,533,559 | A | 7/1996 | Judkins |
| 5,566,735 | A | 10/1996 | Jelic |
| 5,630,458 | A | 5/1997 | Holden |
| 6,431,248 | B1 | 8/2002 | Hyman et al. |
| 6,484,787 | B1 | 11/2002 | Walters |
| 6,637,493 | B1 | 10/2003 | Lampers |
| 6,817,399 | B2 | 11/2004 | Berman et al. |
| 6,860,312 | B2 | 3/2005 | Judkins |
| 6,918,425 | B2 | 7/2005 | Nien |
| 6,948,546 | B2 | 9/2005 | Nien |
| 7,000,672 | B2 | 2/2006 | Nien |
| 7,086,446 | B2 | 8/2006 | Kollman et al. |
| 7,117,918 | B2 | 10/2006 | Franssen |
| 7,225,850 | B2 | 6/2007 | McCarty |
| 7,261,138 | B2 | 8/2007 | Judkins |
| 7,318,251 | B2 | 1/2008 | Lin |
| 2006/0144526 | A1 | 7/2006 | McGinley |
| 2007/0023149 | A1 | 2/2007 | Lamars et al. |

*Primary Examiner* — David Purol

(74) *Attorney, Agent, or Firm* — Buchanan Ingersoll & Rooney PC

(57) ABSTRACT

A Roman shade is provided with a child safety device that includes a plurality of release devices configured for attachment to the shade material of the Roman shade. Each release device includes a female member and a male member that releasably connect together such that one member is attached to the shade material and the other member has an opening through which a lift cord passes. The male member and female member of each release device are sized and configured to separate when a release force acts on at least one of the female members and male members. A kit for retrofitting Roman shades to include such safety devices is also disclosed.

3 Claims, 8 Drawing Sheets

FIG.5
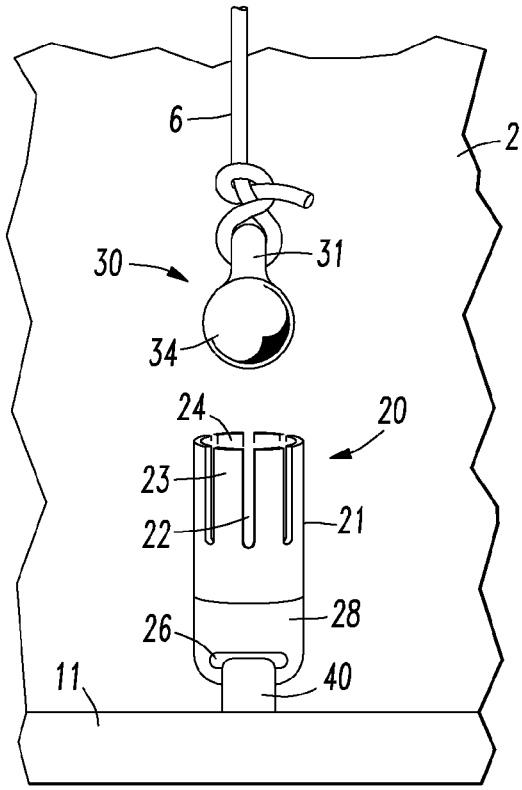
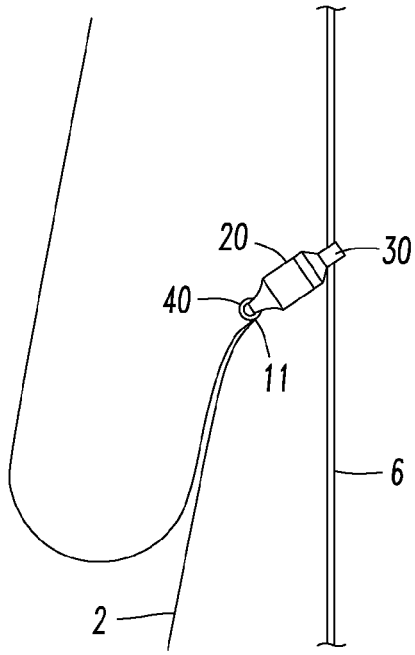
FIG.6

KIT FOR A ROMAN SHADE

CROSS-REFERENCE TO RELATED APPLICATIONS

This application is a continuation of U.S. patent application Ser. No. 12/390,952, filed Feb. 23, 2009 and also claims the benefit under 35 U.S.C. §119(e) of pending U.S. Provisional Patent Application Ser. No. 61/118,227 which was filed on Nov. 26, 2008.

FIELD OF THE INVENTION

This invention relates to window coverings such as Roman shades, and more particularly, to a child safety device and child safety kit that are used for such shades.

BACKGROUND OF THE INVENTION

One popular type of window covering is known as a Roman shade which may also be called a Roman blind, an Austrian shade, a Balloon Shade, or a Soft Shade. This type of shade consists of a panel or sheet of material attached along its top edge to a headrail and gathered at spaced intervals to provide a series of soft folds across the face of the fabric. Consequently, the typical Roman shade has a cascaded or softly pleated appearance. Such Roman shades are constructed so that when they are raised from an extended position, they gather from the bottom in generally horizontal folds or pleats until the entire shade resides near the top of the window covering in a retracted position. In some versions, the top of the window covering may also be towered. The shades are operated by pulling on various lift cords which are used in conjunction with guides attached to the shade.

Most prior art Roman shades are formed either of a sheet of a flexible material such as a fabric or film or of a plurality of segments of material connected together. The material or interconnected segments are typically provided with a plurality of horizontal folds at points vertically spaced from one another to form folds when the shade is raised. A common method for making a Roman shade is to sew at least two sets of rings or connectors along vertical lines down the back of the fabric material as is shown in U.S. Pat. No. 1,321,800. The spacing of the rings or connectors affects the aesthetic effect of the shade and how the window covering material may look when being raised or lowered. Lift cords pass through the rings and each lift cord is attached to a bottom rail or the lowermost fold. The lift cords pass are wound on a spool or shaft in the headrail. The spool or shaft may be turned by a cord loop device or a spring motor to raise and lower the shade. Alternatively, the lift cords may pass through a cord lock and be moved by a user to turn the spool or shaft.

The shade may also include spacer cords that pass through the rings. The spacer cords are typically attached to the headrail of the shade and the rings and are configured to help improve the aesthetic effect of the shade when the window covering material is raised or lowered.

Roman shades may be fabricated by fabricators to make a Roman shade in a custom size to fit a customer's window opening. Fabricators may mistakenly measure or determine the necessary length of the window covering material of a Roman shade or the desired positioning of the rings on the back of the window covering material. For instance, a fabricator may want to adjust the position of the rings to achieve a different aesthetic effect for the raising and lowering of window covering material after reviewing the look provided by the initial positioning of the rings. Since rings are often sewn or affixed to the window covering material, such repositioning can be difficult and time consuming.

Ribs, such as the ribs disclosed in U.S. Pat. No. 5,566,735, may be used by a fabricator instead of the rings to permit the fabricator to make adjustments to the locations of the ribs. The ribs may extend the width of the window covering material and are attached to spacer cords by fasteners. The ribs are configured to hold the window covering material at different spacing intervals and prevent the window covering material from falling vertically out of the ribs. The ribs are also configured to permit the material to be laterally slid out of the ribs so the positioning of the ribs can be changed by a fabricator. The spacing of the ribs acts similarly to the spacing of the rings and affects the look of the window covering material. For instance, spacing of the ribs can permit the material to have a cascading appearance when the shade is lowered and maintain this appearance when the shade is raised.

On occasion, children have been able to get behind a lowered Roman shade and become entangled in one of the lift cords. If the lift cord is around the child's neck and the child falls, the cord could act as a noose and strangle the child. Indeed, reports of such incidents have prompted a major retailer to issue a recall of one product line of Roman shades and the United States Consumer Product Safety Commission has issued a warning about the danger of child entanglement and hanging from the cords in Roman shades.

There have also been incidents of child entanglements in lift cords of venetian blinds and other types of window coverings. As a result, the art has developed various types of child safety devices that are intended to prevent deaths of children who become entangled in lift cords. For instance, U.S. Pat. Nos. 7,261,138, 7,225,850, 7,117,918, 7,086,446, 7,000,672, 6,948,546, 6,918,425, 6,860,312, 6,637,493, 6,484,787, 5,630,458, 5,533,559 and 4,909,298 disclose child safety devices for blinds. Child safety devices may be configured to keep the lift cords taught so that the cords cannot be pulled away from the window covering material and form a noose or release the cord from the shade when a child becomes entangled in the shade. Most, if not all of the cord release devices are not well suited for use on Roman shades. Moreover, many conventional child safety devices for blinds are visible from the front of the shade and detract from the aesthetic effect of the shade.

A new safety device is needed for Roman shades. Preferably, such a device can be sold in a kit to retrofit previously sold Roman shades or shades in a retailer's inventory. Moreover, such a safety device preferably does not detract from the aesthetic effect provided by the Roman shade.

SUMMARY OF THE INVENTION

An improved Roman shade is provided that includes a sheet of material connected to a headrail that is gathered at selected intervals to provide a series of transverse pleats or folds and lift cords for raising and lowering the shade. The Roman shade also includes a plurality of release devices attached to the sheet of material. Each of the release devices includes a male member and a female member releasably connected together. One of the members is attached to the sheet of material and the other member has an opening through which one of the lift cords pass. The male member and female member of each release device are sized and configured to separate when a release force acts on at least one of the female member and the male member.

Embodiments of my Roman shade can include cord operated Roman shades that have a cord lock attached to a headrail. The lift cords pass through the cord lock and may be raised or lowered to lift or lower the shade.

The female member of each release device may have various different configurations. In one embodiment, the female member may include a generally cylindrical body that defines an opening. The opening can be sized to receive and releasably hold a male member. The cylindrical body preferably has at least one slit formed in the body. The one or more slits may communicate with the opening. Other embodiments of my shade may include female members that have a body that defines an opening and a spring positioned in the opening. Preferably, the spring is a coil spring, a torsion spring, or an elastomeric spring.

It should be appreciated that embodiments of my Roman shade can include loops or rings attached to the sheet of material. Each female member may include a clip portion that is sized and configured to attach to one of the loops. The clip portion of the female member may be integral with a body portion of the female member.

Embodiments of my Roman shade may also include a bottom rail attached to the sheet of material and a plurality of receptacles attached to the bottom rail. The lift cords can be sized to extend to the bottom rail and each lift cord can have an end attached to a respective mateable body that is sized and configured to be inserted into an opening in at least one of the receptacles attached to the bottom rail. A releasable attachment is made after the mateable body is inserted into the opening in the receptacle. Release will occur when a predetermined release force acts on the mateable body. Preferably, the receptacles are female members and the mateable bodies are male members.

Some embodiments of my Roman shade include a plurality of loops attached to the sheet of material. The loops include a first series of rings that are aligned with each other and a second series of rings that are aligned with each other. A first lift cord may extend through the rings of the first series of rings and a second lift cord can extend through the rings of the second series of rings. The release devices may include a first series of release devices and a second series of release devices. Each release device of the first series of release devices can include a female member that is attached to a respective ring of the first series of rings to attach that female member to the sheet of material. Each release device of the second series of release devices may include a female member that is attached to a respective ring of the second series of rings to attach that female member to the sheet of material.

It should be understood that the sheet of material may be a fabric sheet, interconnected segments of material, a film, or a panel of woven wood or woven grass. The sheet of material may also include a series of bars or rods that are attached to the sheet of material or held within tubes or pockets sewn or otherwise formed in the sheet of material.

I additionally provide a Roman shade that includes a headrail, window covering material adjacent the headrail and a plurality of lift cords that extend from the headrail to the window covering material. Each lift cord is sized and configured to extend through one or more loops attached to the window covering material. The shade may be raised to retract the window covering material or lowered to extend the window covering material. A plurality of mateable bodies is also included in the Roman shade. Each mateable body is attached to one of the lift cords and is sized to pass through at least one of the loops. A plurality of receptacles are attached to at least one of a bottom portion of the window covering material and a bottom rail attached to a bottom portion of the window covering material. Each receptacle has an opening sized and configured to releasably hold one or more of the mateable bodies.

I further provide a Roman shade that includes a headrail, window covering material adjacent the headrail and a plurality of lift cords that extend from the headrail to the window covering material. Each lift cord is sized and configured to extend through one or more loops attached to the window covering material. The shade may be raised to retract the window covering material or lowered to extend the window covering material. A plurality of receptacles is also included in the Roman shade. Each receptacle is attached to one of the lift cords and is sized to pass through at least one of the loops. A plurality of mateable bodies are attached to at least one of a bottom portion of the window covering material and a bottom rail attached to a bottom portion of the window covering material. Each mateable body is sized to be releasably held within an opening of a receptacle.

I also provide a kit for Roman shades that includes a plurality of male members and a plurality of female members. The female members or the male members are sized and configured for attachment to a sheet of material and the other members each have an opening sized and configured to receive a lift cord. Each of the female members are sized and configured to release one of the male members after that male member is releasably connected to that female member when a release force acts on at least one of that female member and that male member.

In some embodiments of my kit, each female member may include a body that has an opening sized and configured to releasably hold at least one of the male members. One or more slits may be formed in the body. The one or more slits can communicate with the opening.

In other embodiments of my kit, each female member includes a spring positioned in the opening of a body that is sized to receive at least one of the male members. Preferably, the spring is a coil spring, a torsion spring or an elastomeric spring positioned in the opening.

Other details, objects, and advantages of the invention will become apparent as the following description of certain present preferred embodiments thereof and certain present preferred methods of practicing the same proceeds.

BRIEF DESCRIPTION OF THE FIGURES

Present preferred embodiments of my Roman shade having a child safety cord release and kit for providing a cord release on a Roman shade are shown in the accompanying drawings and certain present preferred methods of practicing the same are also illustrated therein.

FIG. 5 is top view of a first present preferred embodiment of my child safety cord release device in a separated position with the male portion connected to one end of a lift cord and the female portion connected to the shade material.

FIG. 6 is an enlarged side view of the first present preferred embodiment of my child safety cord release device connected between the shade material and a ring through which a lift cord runs.

DESCRIPTION OF PRESENT PREFERRED EMBODIMENTS

Figure 1:
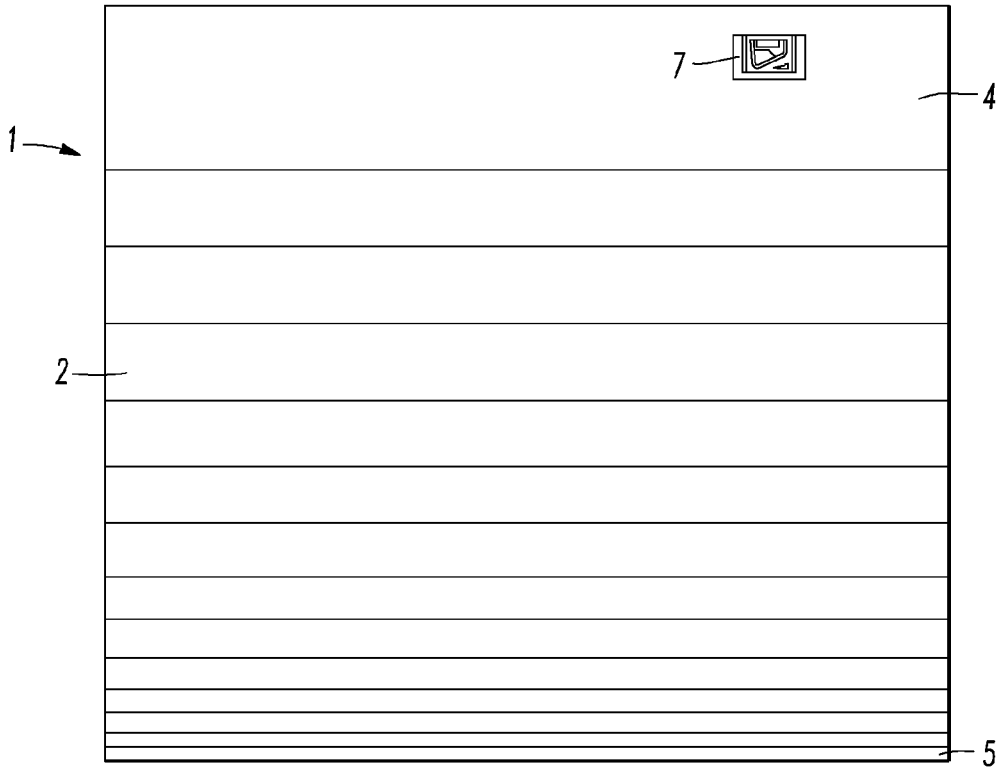
FIG. 1 is a front view of the present preferred embodiment of my Roman shade having a child safety cord release in a raised, or retracted, position.
Figure 2:
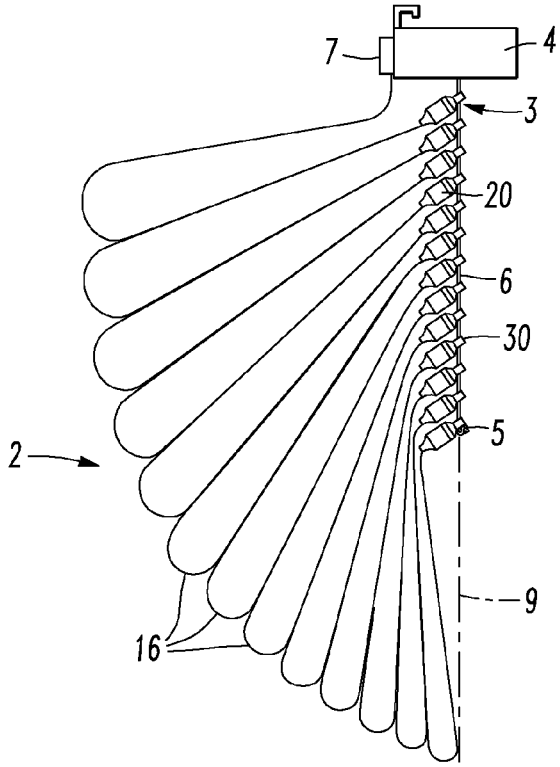
FIG. 2 is a side view of the embodiment shown in FIG. 1 in a raised position.
Figure 3:
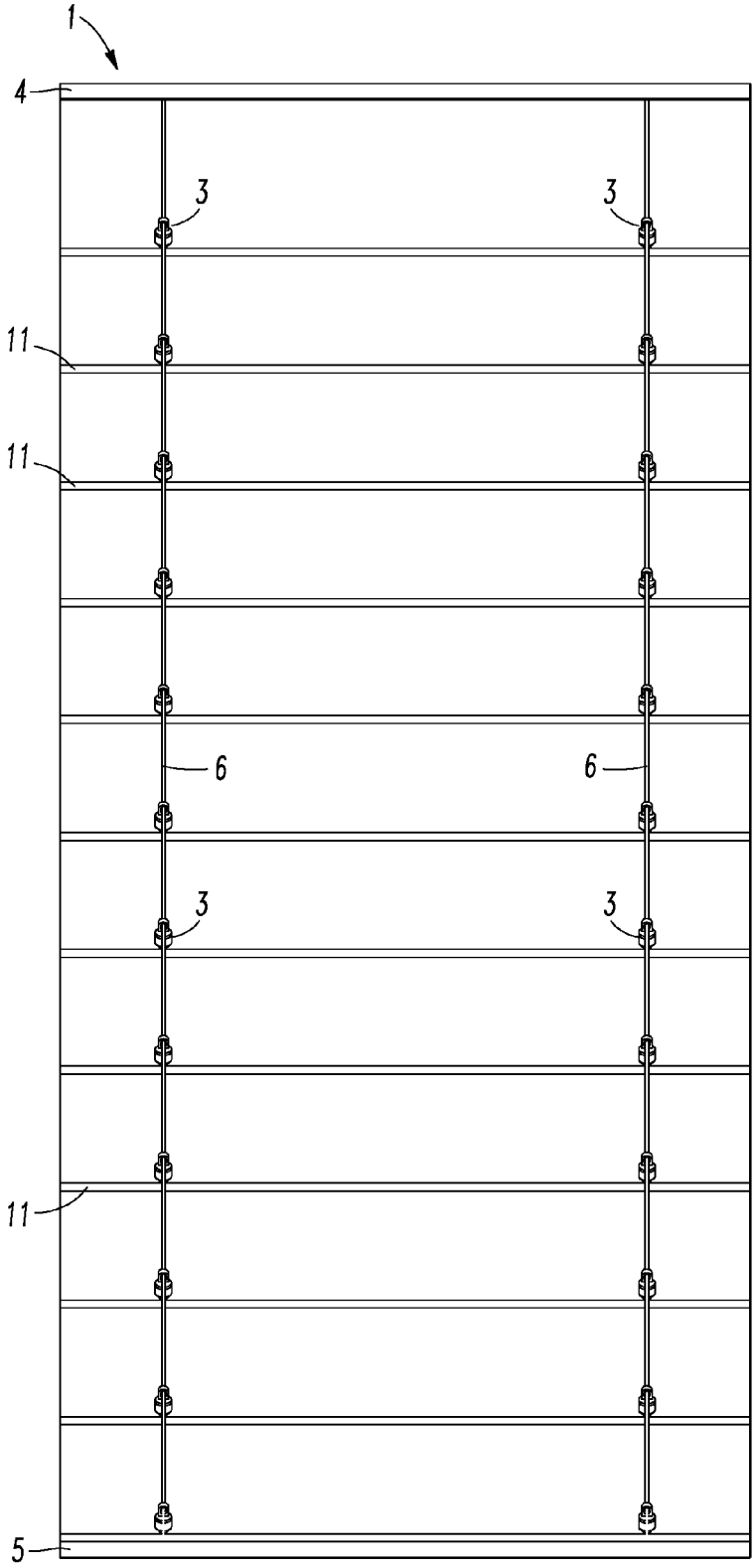
FIG. 3 is a rear view of the embodiment of FIGS. 1 and 2 in a fully lowered position.
Figure 4:
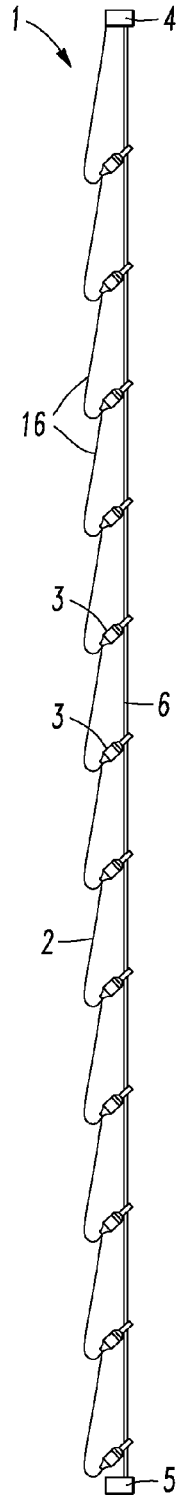
FIG. 4 is a side view similar to FIG. 2 showing the embodiment of FIGS. 1 thru 3 in a lowered, or extended, position.

Referring to FIGS. 1 thru 6, an embodiment of my Roman shade 1 with child safety cord release devices includes a sheet of fabric material 2 which is not pleated. A plurality of loops or rings is attached to the sheet of shade material 2. A top edge of the sheet of material 2 is connected to a headrail 4 and the bottom edge of the sheet of material 2 may be connected to a bottom bar or rail 5. The sheet of material 2 has a series of horizontal folds creating tabs 11 on the back of the shade. In some embodiments, each of the tabs 11 may include a rod or bar that is held within a pocket sewn into the sheet of material. The tabs 11 may define segments 16. The segments 16 could be made of separate strips of material with adjacent strips being sewn together at each tab 11. A skirt 9, shown in dotted line in FIG. 2 may extend from the bottom rail 5. Lift cords 6 pass through a cord lock 7, run down the back of the shade and are attached to the bottom bar 5.

Although I prefer that the sheet of shade material 2 be a woven or non-woven fabric, the sheet of material 2 could be a panel of woven woods, a panel of woven grasses or a film. The sheet of shade material 2 may include multiple interconnected segments of material or be a unitary sheet of material.

Cord release devices 3 are attached to the sheet of shade material 2. As may be best seen in FIGS. 2, 5 and 6, each release device includes a male member 30 and a female member 20. The male member 30 can have an elongated body 31 with a ball 34 at one end. The ball 34 may be spherical or polygonal in shape. I prefer that the ball 34 and opening 24 have a circular or oval cross-section through its longitudinal axis. However, the ball 34 and opening 24 may also have cross-sections that are square, rectangular, triangular or other polygon shapes.

The female member 20 has a generally tubular portion 21 having a series of longitudinal slits 22 creating a series of fingers 23 arranged side by side around a circle to form a basket. The slits 22 communicate with an opening 24 defined by the tubular portion. The opening 24 is sized to receive the ball portion 34 of the male member 30. The opening 24 may be a cavity that has a circular or oval cross-section along its longitudinal axis. Preferably the cross-section of the opening 24 along an axis normal to the longitudinal axis is circular. A tab portion 28 extends from the tubular portion 21 and has a slot 26 through which passes a loop 40 sewn in a tab 11 of the shade material 2 or other portion of the shade material 2. Loops 40 could also extend from the bottom rail 5.

As shown in FIG. 5, the male member 30 is attached to one end of the lift cord 6. The fingers 23 defined in the tubular portion 21 are sized and shaped to hold the ball 34 of the male member 30 securely enough that the connection will be maintained while the Roman shade is raised and lowered. However, should a child become entangled in the cord the male member will release from the female member.

Figure 7:
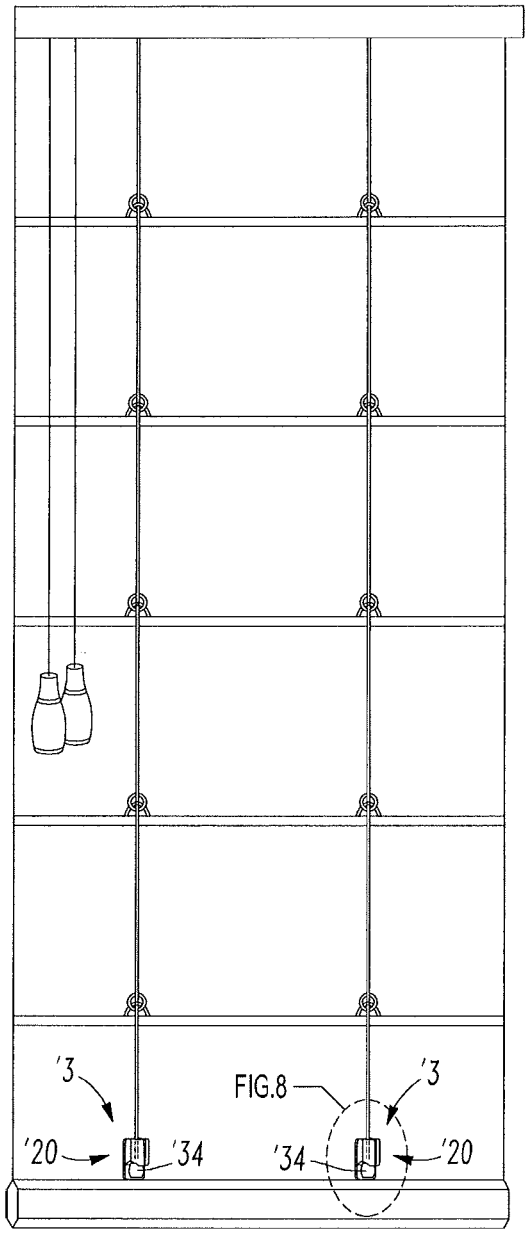
FIG. 7 is a rear perspective view of a second present preferred embodiment of my Roman shade.
Figure 8:
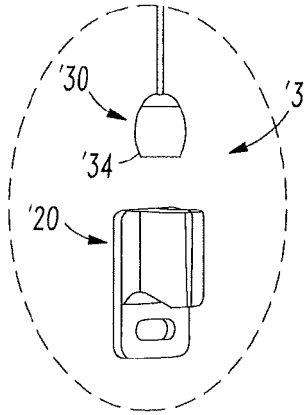
FIG. 8 is a fragmentary view of the second present preferred embodiment of my Roman shade illustrating the female and male members of the release device in a separated position.

One could provide only a limited number of cord release devices 3'. For instance, there could be a male member '30 that includes a ball portion '34 on an end of each lift cord that is releasably connected to a female member '20 attached to the bottom rail, as shown in FIGS. 7-8. In embodiments of Roman shades that only include two lift cords, only two release devices 3 would then be needed. However, I prefer to provide a cord release device on each ring or loop 40 the lift cords pass by, as may be appreciated from FIGS. 2, 5 and 6.

Preferably, both the male member 30 and the female member 20 of the release device 3 are made of the same material. Preferably, the members are composed of plastic such as ABS plastic. Of course, the male and female members could be made of any one of dozens of other plastics including polycarbonate, polyvinyl chloride and acetyl polymers. It is contemplated that the male and female member could also be composed of metal or other materials as long as the geometry of the parts is in accordance with the considerations mentioned below to account for the material's mechanical properties and dimensions of the parts.

There are several inter-related material properties and dimensions which determine the breakaway force, or release force. These include the flexural modulus of the material, tensile yield strength of the material, coefficient of static friction between the male member and the female member, thickness of the fingers, length of the fingers or slits, ratio of size of the cavity and the diameter of the ball end of the male member and the angle formed by a center line through the male member and a centerline through the female member.

I prefer to provide a release device that has the male members configured to separate from the female members when three pounds more than the weight of the shade held by the lift cords act on at least one of the members of the release device. However, the cord release device can be configured to provide separation of the members at lower or higher release forces. For instance, the release force may be as low as three pounds or a force as high as twenty pounds. It should be understood that the "release force" is a force that is in addition to the weight of the shade material and other portions of the shade being held by the lift cords when the shade is mounted to a window opening. Preferably, each cord release device is designed for compliance with ANSI standard A1.3.4.4.2.3.4.

It is possible to adjust the release force by changing the size or configuration of the female members or male members. For instance, I have found that the release force can be changed by adjusting the length of the slits 22. Longer slits would cause the male members 20 to separate from the female members 30 at a lower force than shorter slits.

Figure 9:
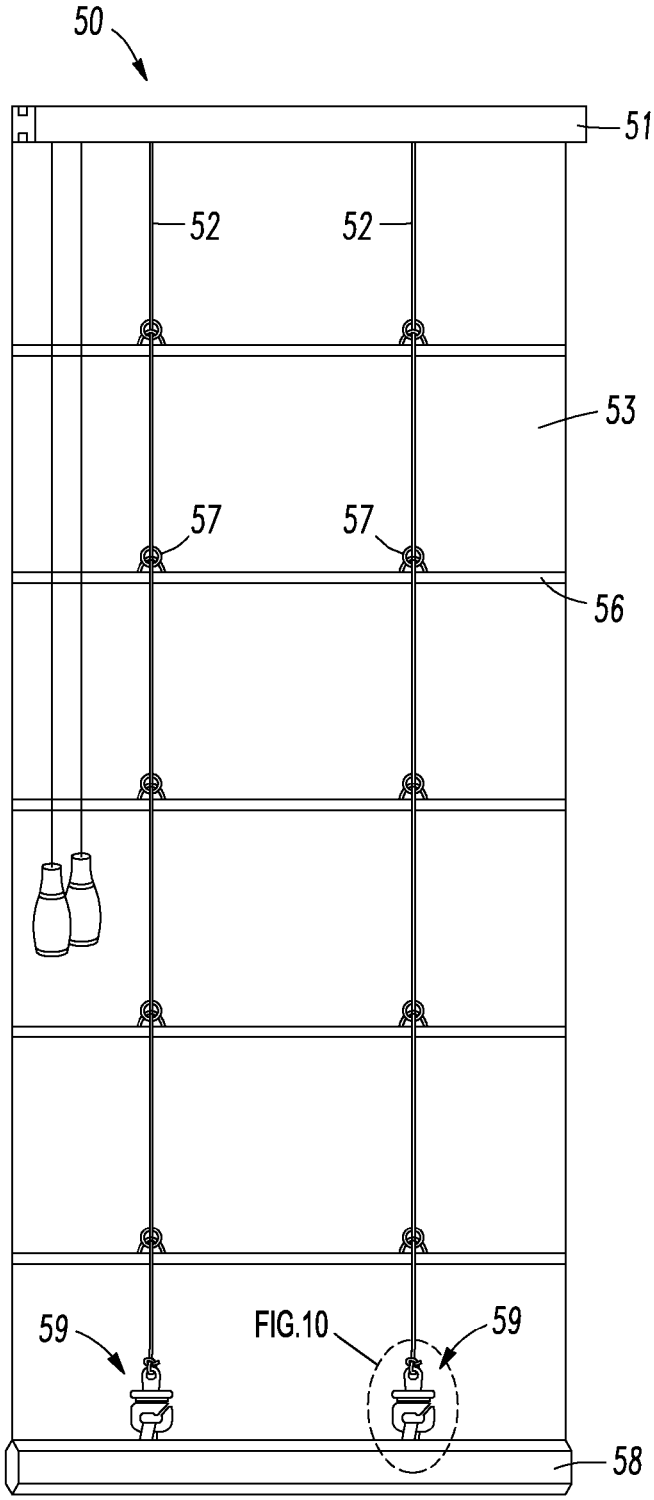
FIG. 9 is a rear perspective view of a third present preferred embodiment of my Roman shade.
Figure 10:
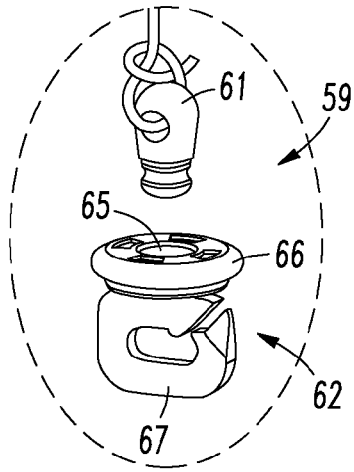
FIG. 10 is a fragmentary view of the third present preferred embodiment of my Roman shade illustrating the female and male members of the release device in a separated position.

Another present preferred embodiment of my Roman shade 50 is shown in FIGS. 9 and 10. The Roman shade includes a headrail 51, window covering material 53 that extends from the headrail to a bottom rail 58 and lift cords 52 that extend from the headrail 51 to the bottom rail 58. The lift cords 52 pass through rings 57 that are attached to the window covering material. The rings 57 are arranged in two series of rings 57 that are each vertically aligned with each other. Each lift cord 52 passes through a respective set of aligned rings 57. An end of each lift cord 52 is attached to a male member 61 of a release device 59, which is sized to pass through the rings 57. A female member 62 of each release device 59 is attached to the bottom rail 58. The male member 61 is releasably held within an opening 65 in a body portion 66 of the female member 62. A clip portion 67 of each female member is attached to a loop that extends from the bottom rail 58.

The release devices 59 are configured to release the lift cords 52 and male members 61 when a release force acting in an upward direction acts on the male members 61. Preferably, the release force is between three pounds and twenty pounds. A spring (not shown) may be positioned within the opening 65 of each female member to configure the female member to release a respective male member upon an application of a particular release force. Preferably, the spring is a coil spring, an elastomeric spring or torsion spring. The spring may also be configured to receive a portion of the male member 61 and releasably retain that portion of the mate member in the opening 65 until a release force acts on the male member.

Figure 11:
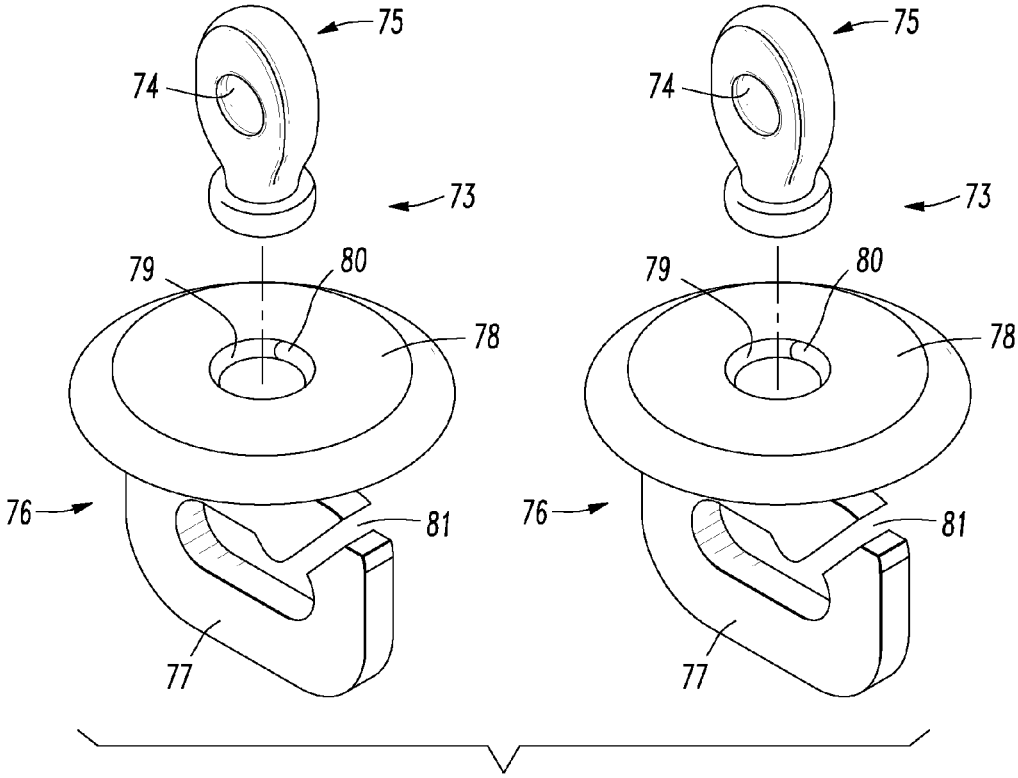
FIG. 11 is a perspective view of a first present preferred embodiment of my child safety kit.
Figure 12:
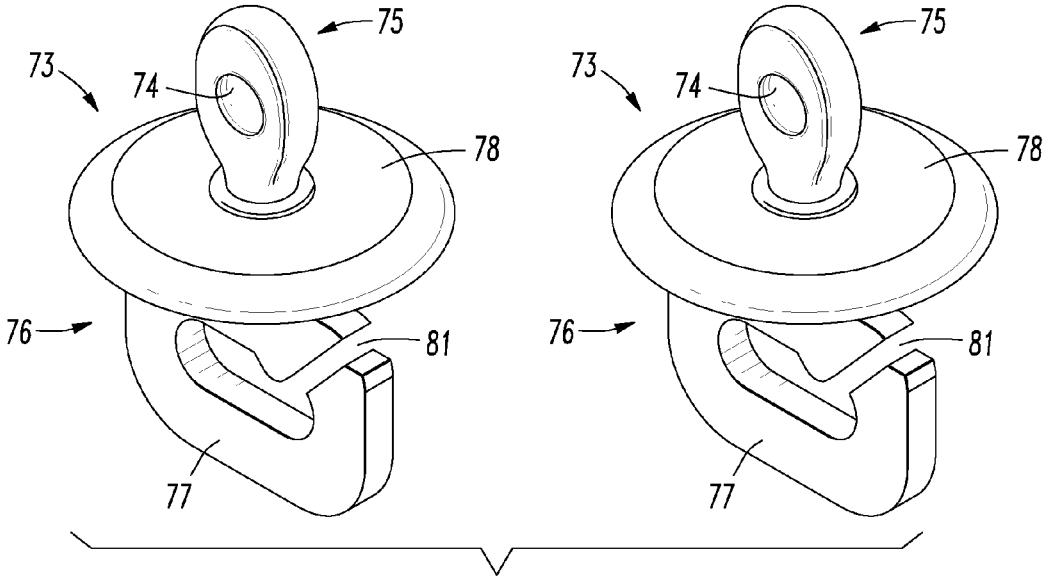
FIG. 12 is a perspective view of the first present preferred embodiment of my child safety kit with the female members and male members releasably connected.

A first present preferred child safety kit 71 is shown in FIGS. 11 and 12. The safety kit 71 includes a plurality of safety devices 73. Each of the safety devices 73 include a male member 75 and a female member 76. The male members 75 each have a body that defines an opening 74 to receive a lift cord. The female members 76 each include a clip portion 77 that is integral with a body portion 78. The clip portions 77 each define an opening 81 that is sized and configured to releasably attach to a ring or loop of a Roman shade. The body portion 78 of each female member 76 defines an opening 79. The opening 79 retains a spring 80. The spring is sized and configured to releasably retain a portion of the male member within the opening 79, as may be appreciated from FIG. 12. Preferably, the spring 80 is a coil spring, torsion spring or elastomeric spring. The male members 75 and female members 76 of the kit 71 may be sold or packaged separately or sold and packaged together. It should be understood that the male members 75 or female members 76 may be sized so that they can pass through rings or loops of a Roman shade.

Embodiments of my safety kit may be used to retrofit existing Roman shades to provide child safety features. For instance, the female members provided in embodiments of my kit may be attached to the bottom rail of a Roman shade or bottom portion of the shade material and the male members may be attached to the ends of lift cords. Such a retrofitted shade could appear similar to the second present preferred embodiment 51 shown in FIGS. 9 and 10.

Of course, embodiments of my safety kit may also include more than two safety devices. For instance, a user could provide a safety device on each loop or ring of a Roman shade such that each male member is attached to a lift cord and each female member is attached to respective loop or ring. As another example, each female member may be attached to one of the lift cords and a male member may be attached to a respective ring or loop.

Figure 13:
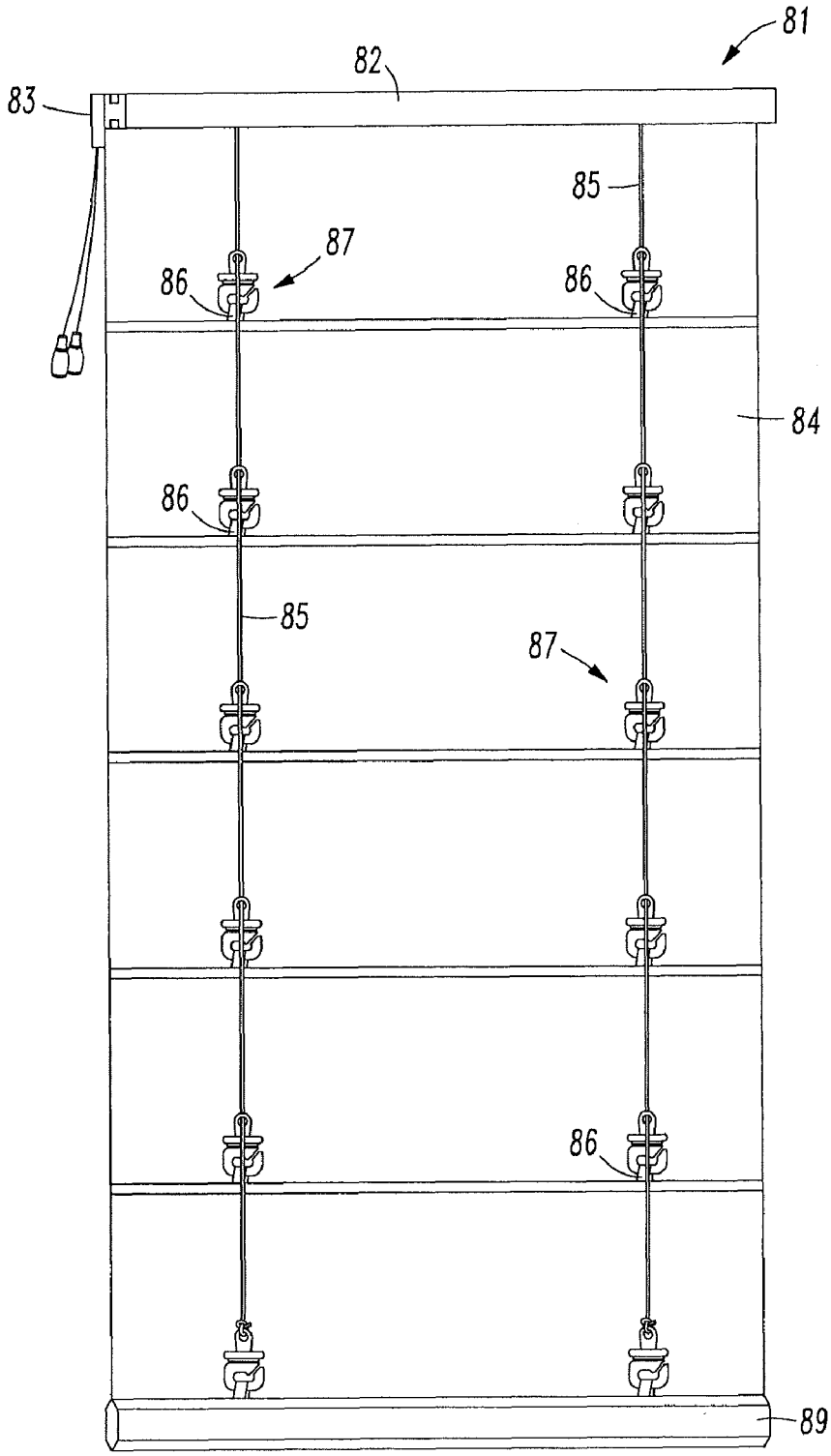
FIG. 13 is a rear perspective view of a fourth present preferred embodiment of my Roman shade.

Referring to FIG. 13, an embodiment of my Roman shade 81 can include a headrail 82 that is attached to a valance 83 and window covering material 84. The bottom portion of the window covering material is attached to a bottom rail 89. Each segment of the window covering material has a plurality of rings, or loops 86. The loops 86 include two sets of loops that are vertically aligned. A safety device 87 is attached to each loop 86. Each safety device includes a female member that is attached to the loops 86 and a male member that is releasably retained within an opening in the female member. Lift cords 85 extend from a cord lock (not shown) attached to the headrail 82. Each lift cord passes adjacent one set of vertically aligned loops to the bottom rail. The lift cords 85 pass through holes formed in the male members of the safety devices 87. The male member of each safety device may release from its respective female member independently of the other safety devices upon a release force acting on that male member.

Figure 14:
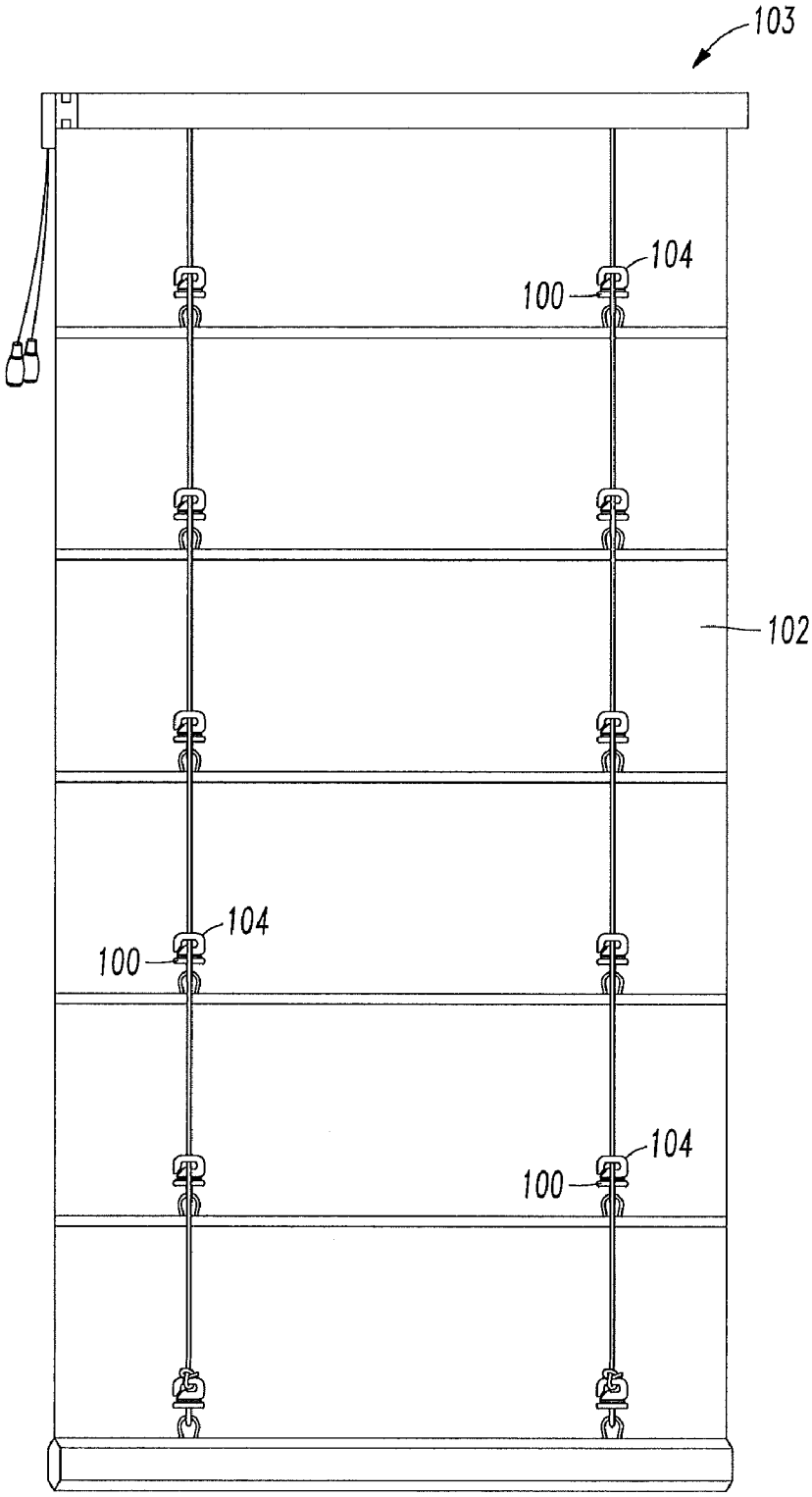
FIG. 14 is a rear view of a fifth present preferred embodiment of my Roman shade.

Of course, other embodiments of my Roman shade may have release devices that include male members attached to the shade material or loops of the shade material and female members attached to the lift cords. Such an embodiment may be seen in FIG. 14, which illustrates a shade 103 that has male members 100 attached to the shade material 102 of the roman shade 103. The female members 104 each include an opening that is sized to receive a portion of a lift cord to attach the lift cord to the female member. Each female member 104 also has an opening sized and configured to releasably connect to a respective male member 100. The female member 104 will release the male member 100 when a release force acts on the female member, the male member, or both members.

Embodiments of my safety kit and embodiments of my Roman shade can provide a Roman shade that includes one or more safety devices that can prevent child entanglement within the lift cords of the shade. The safety devices may be provided only on the back of the shade so they do not detract from the aesthetic effect provided by the front of the shade. Further, the safety devices can be sized to be relatively small so they are not readily apparent to a typical homeowner from the rear of the shade. As a result, the safety devices may not detract from the aesthetic effect provided by the rear of the shade, which may be seen through a window.

It should be appreciated that other variations of the present preferred embodiments discussed above may be made. For example, the number of lift cords required for any particular Roman shade can vary according to the size and weight of the shade material as well as the release force required to separate the cord release device attached to the shade. As another example, safety devices may include male members that have mateable bodies of different shapes or sizes than those described above. As yet another example, the safety devices may also include female members that have receptacles that are configured for releasable connection to the male members that have different sizes or shapes than those described above.

While certain present preferred embodiments of my Roman shade and certain embodiments of methods of practicing the same have been shown and described, it is to be distinctly understood that the invention is not limited thereto but may be otherwise variously embodied and practiced within the scope of the following claims.

I claim:

1. A child safety kit for retrofitting Roman shades having a sheet of material comprising:

a plurality of male members;

a plurality of female members; and the female members and the male members sized and configured to releasably connect together, one of the female members and male members being sized and configured for attachment to a sheet of material of a type used in Roman shades and the other members each having an opening sized and configured to receive a Roman shade lift cord, each of the female members being sized and configured to release one of the male members after that male member is releasably connected to that female member when a release force acts on at least one of that female member and that male member; and each of the female members being comprised of a body that defines an aperture sized and configured to releasably hold at least one of the male members and also being comprised of a spring positioned in the aperture to directly engage the male member when the male member is connected to the female member.

2. The kit of claim 1 wherein the spring is a coil spring, a torsion spring, or an elastomeric spring positioned in the opening.

3. The kit of claim 1 wherein each female member is comprised of a resilient clip portion that is sized and configured to receive and hold a loop of a Roman shade.

* * * * *